US005746072A

United States Patent [19]

Böhnke

[11] Patent Number: 5,746,072

[45] Date of Patent: May 5, 1998

[54] SYSTEM FOR CONVEYING AND TREATING AN ENDLESS TEXTILE LOOP

[75] Inventor: Bernd Böhnke, Eschweiler, Germany

[73] Assignee: H.Krantz Textiltechnik GmbH, Wurselen, Germany

[21] Appl. No.: 724,012

[22] Filed: Sep. 27, 1996

[30] Foreign Application Priority Data

Sep. 28, 1995 [DE] Germany ..... 195 36 070.2

[51] Int. Cl.[6] ..... D06B 3/28

[52] U.S. Cl. ..... 68/178; 34/640; 226/97.4

[58] Field of Search ..... 68/177, 178, 181 R, 68/20; 34/640, 641, 642, 576; 226/97.4

[56] References Cited

U.S. PATENT DOCUMENTS

| | | | |
|---|---|---|---|
| 2,447,982 | 8/1948 | Koster | 226/97.4 X |
| 3,286,896 | 11/1966 | Kinney | 226/97.4 X |
| 3,576,284 | 4/1971 | Fellous et al. | 226/97.4 |
| 3,771,337 | 11/1973 | Trullas . | |
| 4,322,027 | 3/1982 | Reba | 226/97.4 |
| 4,545,221 | 10/1985 | Daniel . | |
| 4,813,460 | 3/1989 | Van Bogaert et al. | 226/97.4 X |
| 5,326,009 | 7/1994 | Kobayashi et al. | 226/97.4 |

FOREIGN PATENT DOCUMENTS

| | | |
|---|---|---|
| 0 172 406 | 2/1986 | European Pat. Off. . |
| 2 619 834 | 3/1989 | France . |
| 2 046 208 | 2/1972 | Germany . |
| 32 45 921 | 6/1984 | Germany . |
| 41 19 152 | 12/1992 | Germany . |
| 41 20 738 | 12/1992 | Germany . |

*Primary Examiner*—Philip R. Coe
*Attorney, Agent, or Firm*—Herbert Dubno; Andrew Wilford

[57] ABSTRACT

An apparatus for treating an endless textile web by passing it in a direction along an endless path and contacting it with a treatment fluid has a conveying nozzle provided with a housing traversed by the path and having a lateral inlet, an upstream tube and downstream tube longitudinally traversed by the path. The upstream tube has an upstream portion of a cross section decreasing in the direction and a downstream portion of substantially constant cross section and having a downstream end. The downstream tube has an upstream portion of a cross section decreasing in the direction and having an upstream end in the housing upstream of the downstream end of the upstream tube, spaced laterally outward from the downstream portion of the upstream tube, and forming with the downstream portion of the upstream tube a gap open into the housing and a downstream portion of cross section increasing in the direction. The web and path extend through the tubes and a blower connected to the inlet pressurizes the housing and induces a gas flow in the direction through the downstream tube to draw the web longitudinally through the tubes along the path.

9 Claims, 4 Drawing Sheets

SYSTEM FOR CONVEYING AND TREATING AN ENDLESS TEXTILE LOOP

SPECIFICATION

1. FIELD OF THE INVENTION

The present invention relates to a nozzle for conveying an endless textile loop. More particularly this invention concerns a system for conveying and treating such a loop.

2. BACKGROUND OF THE INVENTION

It is known to displace and treat a textile web or strand by means of a nozzle of the type described in European 0,172,406 of G. Eckrodt. Such a nozzle works on the jet-pump principle, with an upstream tube whose downstream end fits with spacing into a flared upstream end of a downstream tube. A gas or liquid under pressure is supplied to the gap between the tubes to create a downstream flow that entrains the web. The conveying medium can even be admixed with a treatment liquid or gas. Such a system subjects the workpiece, here the textile web, to considerable stress. If the pressure is decreased to avoid harming the web, the conveying and saturating efficiency drop substantially, even when as suggested an inert gas is used with the treatment liquid.

German patent 3,245,921 of H. Kreitz describes an entire treatment apparatus where the web endless and is laid in folds in one side of an upwardly open U-shaped vessel while it is drawn up out of the other side of the vessel. A jet-pump nozzle is used to displace the web which is still subjected to considerable mechanical action and stress so that this system is not applicable, for instance, to delicate fabrics.

The web is handled somewhat more gently by the system of German patent 4,119,152 of K. Grafen. A pair of coaxial nested cylindrical tubes form a conveying nozzle and the path of the workpiece is fairly simple. The conveying nozzle works with a very low efficiency so that the system's blower must be fairly big and consumes a great deal of electricity to convey the relatively light workpiece.

A somewhat more efficient conveying nozzle is seen in French patent document 2,619,834 of A. Bene. It has a two-stage jet-pump nozzle that is quite complex to build and maintain. The upstream portion of circular section and the second is more rectangular, of decreasing height and increasing width so that it is quite difficult to manufacture.

OBJECTS OF THE INVENTION

It is therefore an object of the present invention to provide an improved conveying nozzle for a web-treating apparatus.

Another object is the provision of such an improved conveying nozzle for a web-treating apparatus which overcomes the above-given disadvantages, that is which is relatively simple in construction, that is highly efficient, and that treats the web gently.

SUMMARY OF THE INVENTION

An apparatus for treating an endless textile web by passing it in a direction along an endless path and contacting it with a treatment fluid has a conveying nozzle provided with a housing traversed by the path and having a lateral inlet, an upstream tube and downstream tube longitudinally traversed by the path. The upstream tube has an upstream portion of a cross section decreasing in the direction and a downstream portion of substantially constant cross section and having a downstream end. The downstream tube has an upstream portion of a cross section decreasing in the direction and having an upstream end in the housing upstream of the downstream end of the upstream tube, spaced laterally outward from the downstream portion of the upstream tube, and forming with the downstream portion of the upstream tube a gap open into the housing and a downstream portion of cross section increasing in the direction. The upstream portion has a downstream end of a cross-sectional size equal to between 1.3 and 3 times, preferably between 1.5 and 2.5 times, a cross-sectional size of the downstream portion of the upstream tube.The web and path extend through the tubes and a blower connected to the inlet pressurizes the housing and induces a gas flow in the direction through the downstream tube to draw the web longitudinally through the tubes along the path.

The transport gas forced in through the gap or gaps is at its highest speed and lowest pressure where it comes into contact with the web, meeting it at an inflow angle of from 5° to 20°, preferably 5° to 15°. The result is extremely efficient entrainment of the web since the flow thence is substantially laminar. The downstream portion of the downstream end acts as a diffuser, being flared at at most about 10°, so that even here the workpiece is treated very gently, with practically no turbulence in the conveying gas. Furthermore since the gas is introduce from outside, it is possible to thus treat and convey tubular goods, such as many knits, without inflating them and making them hard to manage. Such a nozzle can do the same amount of work as that of above-cited German 4,119,152 with about half the energy consumption. In fact such a nozzle can in principle be used for conveying paper strips, metal foils, or even wood products.

The downstream tube further has an intermediate portion of a substantially constant cross section between and connecting the respective upstream and downstream portions. The cross sections can be generally rectangular or circular. With a rectangular section the upstream end of the downstream tube and the downstream end of the upstream tube are of substantially the same width and thus form two such gaps open into the housing.

The housing can be formed as an upstream continuation of the upstream end of the downstream tube. This continuation is of a substantially constant cross section.

To ensure proper fan-fold deposition of the web, the nozzle is provided with means for oscillating a downstream end of the downstream portion of the downstream tube. To reduce the losses created when dynamic pressure is converted to static pressure and then back again, the housing is provided with quarter-circular guide vanes for directing gas flow from the intake to the gap.

The apparatus according to the invention has a U-shaped receptacle traversed by the path underneath the nozzle, treatment means for applying the fluid to the web between the downstream tube and the receptacle, and means for collecting the treatment fluid and returning it to the treatment means.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
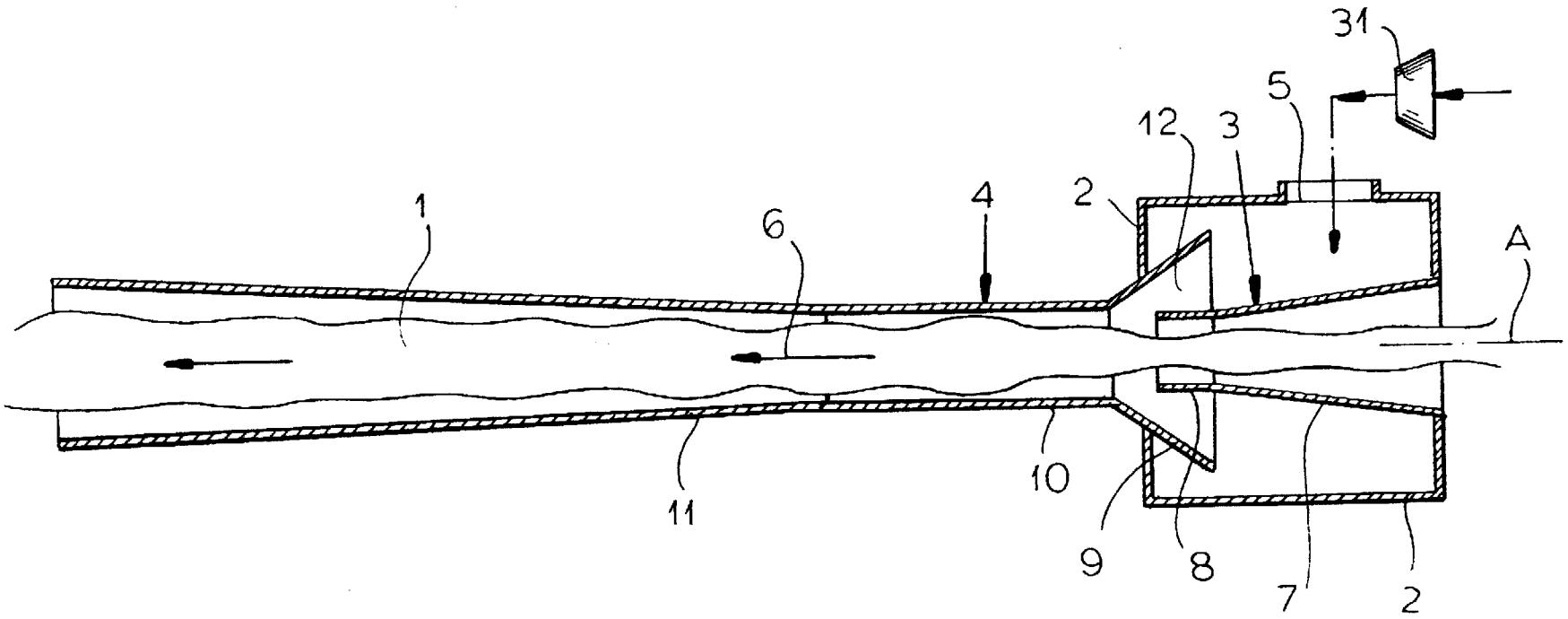
FIG. 1 is a partly diagrammatic longitudinal section through a nozzle according to the invention.

As seen in FIG. 1 a nozzle for conveying a web 1 according to the invention has relative to a web-travel direction 6 an upstream housing 2 formed with a lateral inlet 5 and forming a plenum 13 longitudinally traversed by the web 1. Inside the housing 2 is an upstream tube 3 having an upstream portion 7 that tapers downstream and a downstream portion 8 that is of constant cross-sectional size and shape. A downstream tube 4 has an upstream end 9 that projects into the housing 2 and that has an upstream end that is level with or upstream in the direction 6 from the downstream end of the tube portion 8, and that in fact lies at the juncture of the portion 7 and 8, an intermediate portion 10 of constant cross section, and a downstream portion 11 that flares downstream as a diffuser. The portions 7, 9, and 11 are substantially frustoconical and coaxial to an axis A and the portions 10 and 8 are substantially cylindrical and also coaxial to the axis A. The portion 9 lies partly inside and partly outside the housing 2 and the portions 10 and 11 are wholly outside the housing 2. The flow cross section or cross-sectional size of the portion 9 at its downstream end, that is where it joins the poriton 10 and where it is at its narrowest, is equal to between 1.5 and 2.5 times, here 2 times, the flow cross section of the cylindrically tubular portion 8.

A blower indicated schematically at 31 pressurizes the plenum 13. This pressurized air enters a gap 12 formed between the portions 8 and 9 and flows downstream, entraining the web 1 in the direction 6. The air rushing downstream in direction 6 with the web 1 compacts it at an angle of between 5° and 20°, preferably 5° to 15°, transversely to keep it out of contact with the inner wall surfaces of the tubes 3 and 4. The air is normally moving at 100 m/s and can approach the speed of sound or 140 m/sec. This air speed slows in the diffuser portion 11 so that the web 1 exits the downstream end of the downstream portion 11 gently.

The angle of the wall of the first portion 9 is 10° to 40°, preferably 10° to 30°, while that of the portion 11 is at most about 10° to the axis A. The width of the gap perpendicular to the axis A is roughly the same size as the spacing along the axis A from the downstream end of the portion 8 to the upstream end of portion 10. The cross-sectional area of the portion 10 is equal to that of the downstream end of the portion 9 and about twice that of the portion 8 and the cross-sectional area of the downstream portion 11 increases by two to ten times, preferably three times. The length of the downstream portion 8 is roughly a quarter the length of the portion 7 and about half the axial length of the portion 8. Furthermore the length of the nozzle from the downstream end of the portion 7 to the downstream end of the portion 9 is about equal to the length of the portion 10 and is equal to about a third of the length of the portion 11.

Figure 2:
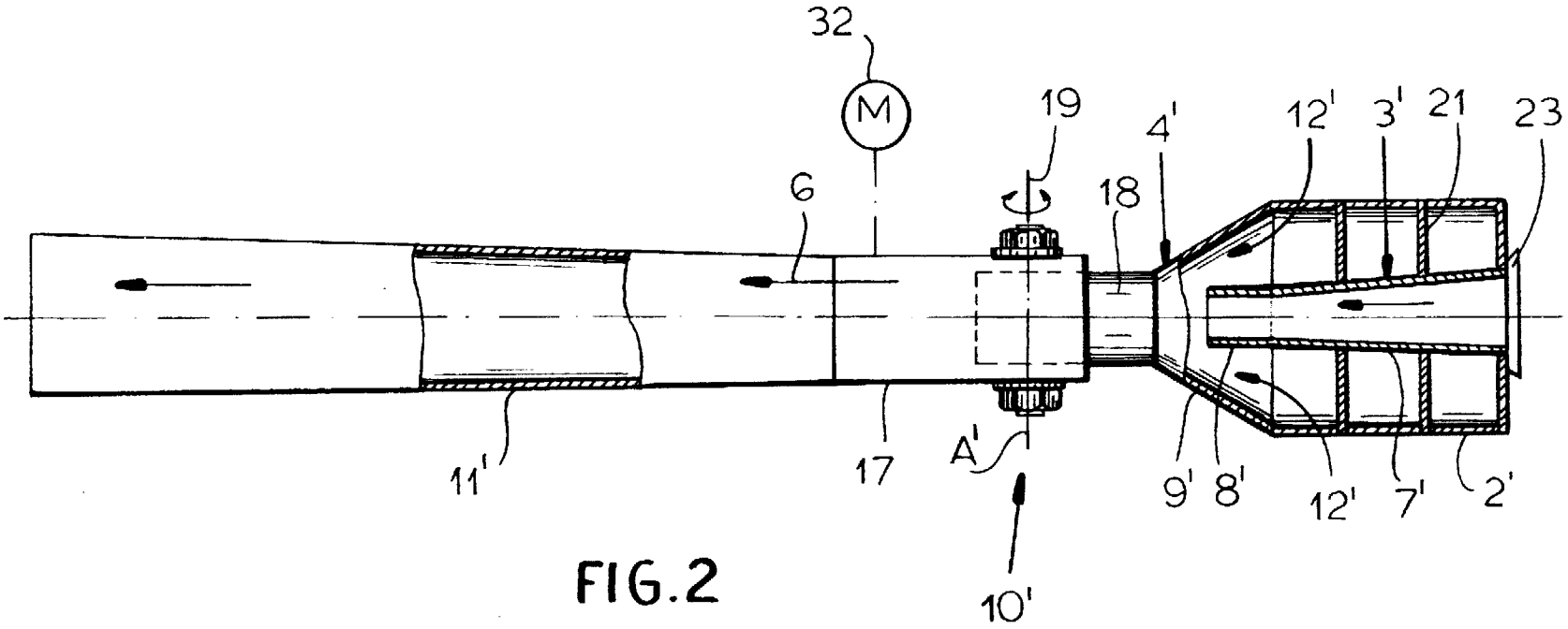
FIGS. 2 and 3 are side and top views partly in longitudinal section through another nozzle in accordance with this invention.
Figure 3:
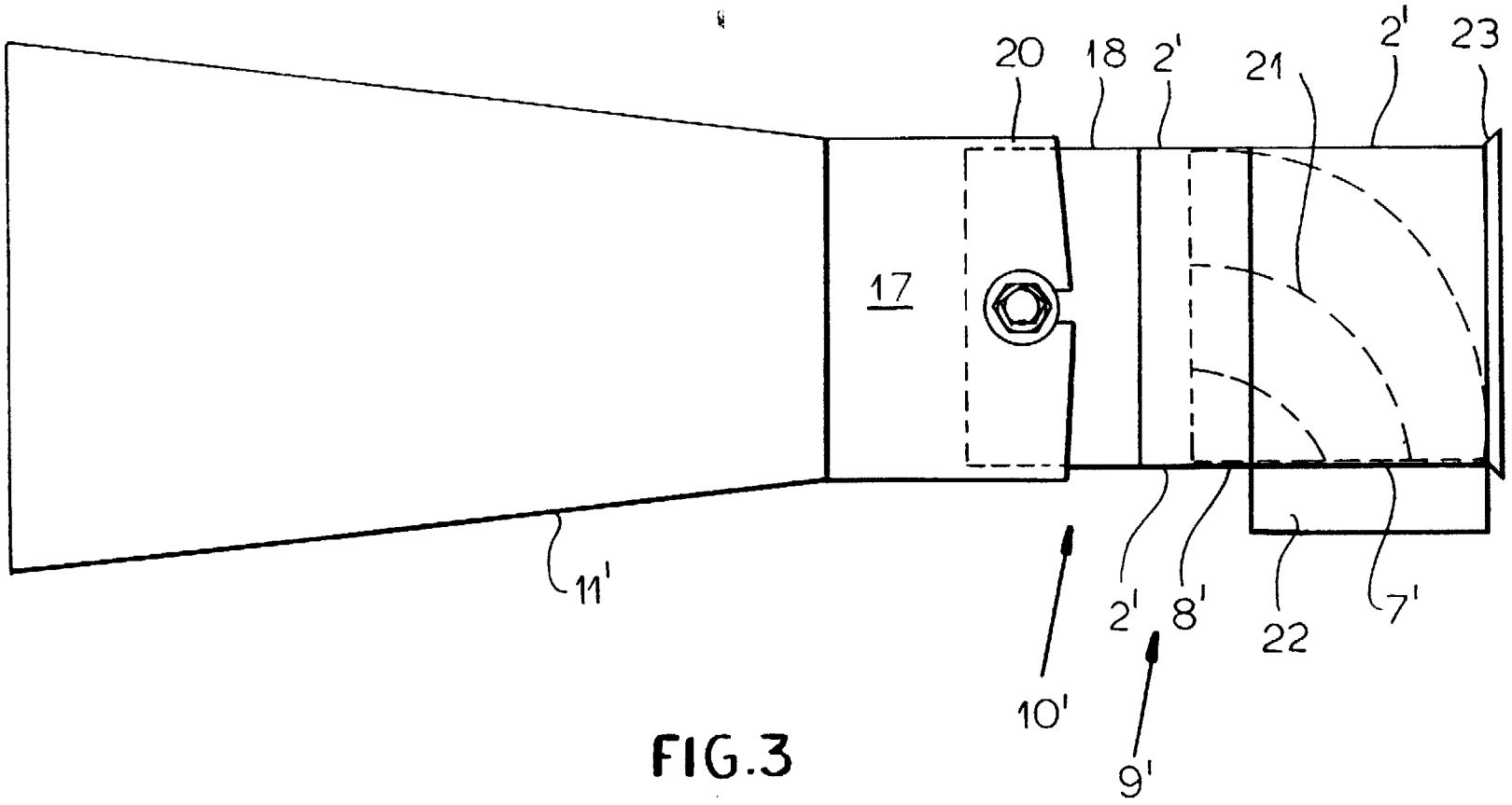

FIGS. 2 and 3 show another embodiment of the invention. Here an upstream housing 2' formed with a lateral inlet 22 contains an upstream tube 3' having an upstream portion 7' that tapers downstream and a downstream portion 8' that is of constant cross-sectional size and shape. A downstream tube 4' has an upstream end 9' that forms the downstream end of the housing 2', an intermediate portion 10' of generally constant cross section, and a downstream portion 11' that flares downstream as a diffuser, the height of the portion 11' increasing only slightly but the width increasing by a factor of 1.5. The side walls of the portion 11 extend at about 9° to the direction 6 and the overall cross section increases by a factor of three.

The housing 2' and tubes 3' and 4' are of rectangular section and are of roughly the same horizontal width as seen in the FIG. 3 top view but are of different heights as is visible in the FIG. 2 side view so as to create two gaps 12' above and below the upstream tube 3', the ratio of width to height being 2:1 to 4:1. The upper and lower walls of the portion 9' extend at about 20° to the transport direction 6. Above and below the upstream tube 3' the housing 2' is provided internally with three quarter-circular vanes or baffles 21 that redirect the air flow from the lateral outlet so that it flows downstream in direction 6. In addition the upstream end of the upstream tube 3' is provided with a collar 23 that flares upstream and that prevents the web 1 from getting caught as it enters the nozzle. The inlet 22 is formed as a wedge with its one wide side extending over the side wall of the portion 7 and extending in the transport plane, pointing perpendicular outward from the direction 6. Normally the housing 2', upstream tube 3', and downstream tube 4' are made of welded stainless-steel plates or sheet metal. The corners, in particular those of the diffuser 11', can be rounded.

The intermediate portion 10' is formed by a downstream section 17 and a slightly smaller upstream section 18 interconnected at a vertical pivot 19 with an overlap at 20. The heights of the portions 17 and 18 in the overlap region 20 are only different basically by an amount equal to twice the wall thickness but the width of the downstream portion 17 is greater by 10% to 20% from that of the portion 18 to accommodate swinging about an axis A'. A motor illustrated schematically at 32 can be connected to the portions 11' and 17 to oscillate them back and forth about the axis A' perpendicular to the direction 6 to lay the exiting web 1 in fan folds.

Figure 4:
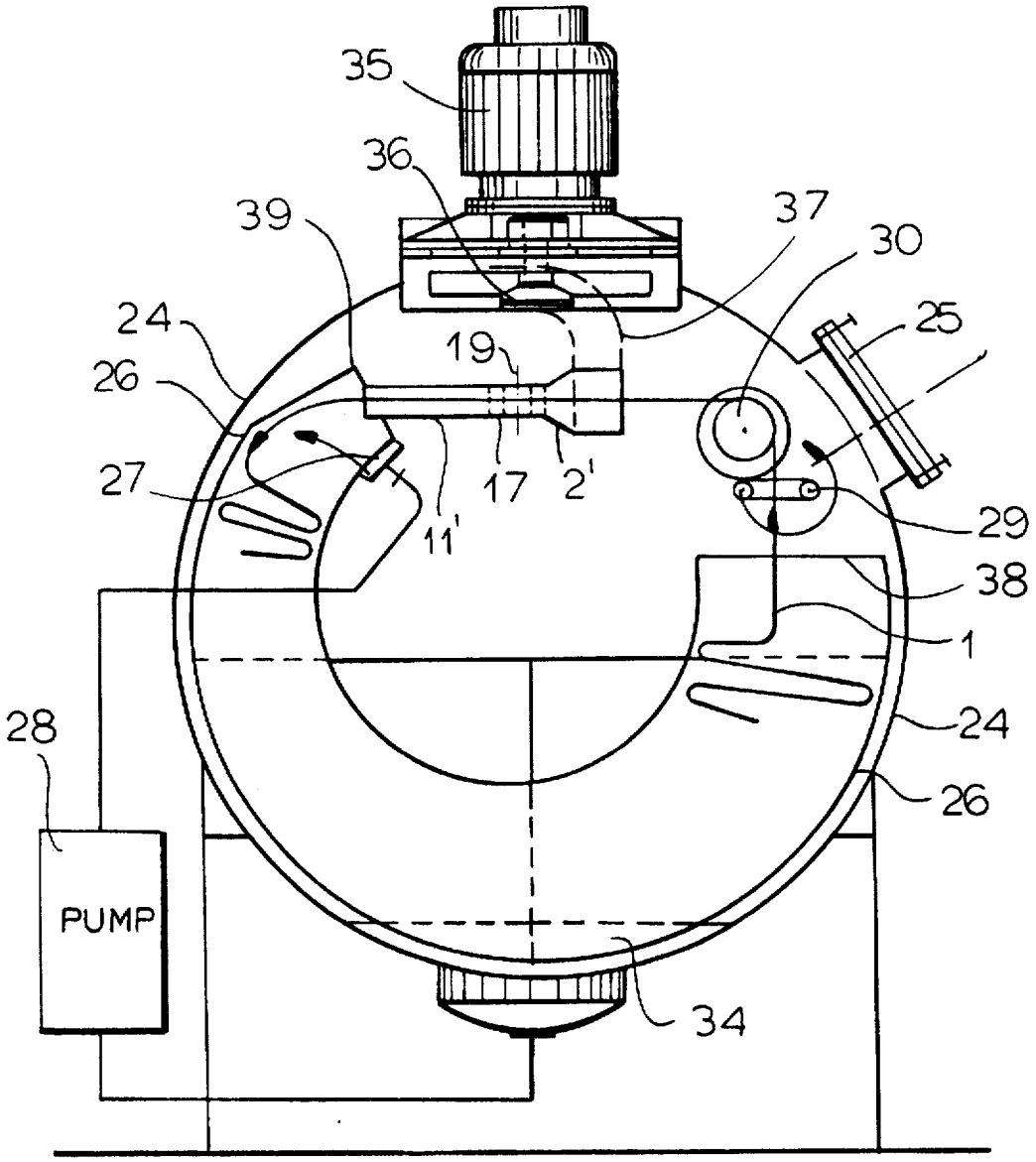
FIG. 4 is a small-scale partly diagrammatic vertical section through a web-treating apparatus according to the invention.

FIG. 4 shows a system of the type generally described in above-mentioned French patent 2,619,834 and German patent document 195 17 298, 3,245,921, and 4,119,152. It has a main basically cylindrical housing 24 provided with a lateral access/loading port 25 and holding an upwardly U-shaped treatment vessel 26. A nozzle as described above with reference to FIGS. 2 and 3 is mounted above the vessel 26 and has its intake 22 connected to an outlet 37 of a fan 36 powered by a motor 35 sitting atop the housing 26. The fan 36 is of the axial-intake/radial output type with the intake in the housing 24.

The web 1 passes in a continuous annular path through the vessel 26 and then up through a guide ring 29 and over an idler/deflecting roller 30 to enter the upstream end of the nozzle. On exiting the nozzle the web enters an upstream end 39 of the vessel 26 where it is sprayed from a treatment nozzle 27 that is supplied dye liquid from a pump 28 whose intake is at a sump 34 in the bottom of the housing 24 and vessel 26.

While this device is normally used for dying textile lots, it can also be used for an enzyme treatment or even a dry tumbling treatment of the web 1.

I claim:

1. In combination with an apparatus for treating an endless textile web by passing it in a direction along an endless path and contacting it with a treatment fluid, a conveying nozzle comprising:

a housing traversed by the path and having a lateral inlet;

an upstream tube longitudinally traversed by the path and having an upstream portion of a cross section decreasing in the direction and a downstream portion of substantially constant cross section and having a downstream end;

a downstream tube longitudinally traversed by the path and having an upstream portion of a cross section decreasing in the direction, the upstream portion having an upstream end in the housing level with or upstream of the downstream end of the upstream tube, spaced laterally outward from the downstream portion of the upstream tube, and forming with the downstream portion of the upstream tube a gap open into the housing, the upstream portion having a downstream end of a cross-sectional size equal to between 1.3 and 3 times a cross-sectional size of the downstream portion of the upstream tube, and a downstream portion of cross section increasing in the direction, the web and path extending through the tubes; and blower means connected to the inlet for pressurizing the housing and inducing a gas flow in the direction through the downstream tube to draw the web longitudinally through the tubes along the path.

2. The web-conveying nozzle defined in claim 1 wherein the downstream tube further has an intermediate portion of a substantially constant cross section between and connecting the respective upstream and downstream portions.

3. The web-conveying nozzle defined in claim 1 wherein the cross sections are generally rectangular.

4. The web-conveying nozzle defined in claim 1 wherein the upstream end of the downstream tube and the downstream end of the upstream tube are of substantially the same width and thus form two such gaps open into the housing.

5. The web-conveying nozzle defined in claim 1 wherein the housing is formed as an upstream continuation of the upstream end of the downstream tube.

6. The web-conveying nozzle defined in claim 5 wherein the continuation is of a substantially constant cross section.

7. The web-conveying nozzle defined in claim 1, further comprising means for oscillating a downstream end of the downstream portion of the downstream tube for depositing the web in folds.

8. The web-conveying nozzle defined in claim 1, further comprising:

quarter-circular guide vanes in the housing for directing gas flow from the intake to the gap.

9. The web-conveying nozzle defined in claim 1 wherein the apparatus further has:

a U-shaped receptacle traversed by the path underneath the nozzle;

treatment means for applying the fluid to the web between the downstream tube and the receptacle; and means for collecting the treatment fluid and returning it to the treatment means.

* * * * *